US008401426B2

(12) United States Patent
Nieda

(10) Patent No.: US 8,401,426 B2
(45) Date of Patent: Mar. 19, 2013

(54) OPENING/CLOSING MECHANISM AND IMAGE FORMING APPARATUS

(75) Inventor: Hiroaki Nieda, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 391 days.

(21) Appl. No.: 12/726,074

(22) Filed: Mar. 17, 2010

(65) Prior Publication Data

US 2011/0052253 A1 Mar. 3, 2011

(30) Foreign Application Priority Data

Aug. 31, 2009 (JP) ..... 2009-199698

(51) Int. Cl.
*G03G 21/18* (2006.01)

(52) U.S. Cl. ..... 399/114

(58) Field of Classification Search ..... 399/110, 399/114, 124

See application file for complete search history.

(56) References Cited

U.S. PATENT DOCUMENTS

| | | | | |
|---|---|---|---|---|
| 2006/0104665 | A1 | 5/2006 | Koshida | |
| 2008/0199211 | A1 | 8/2008 | Koshida | |
| 2008/0240780 | A1 * | 10/2008 | Yamauchi | 399/121 |

FOREIGN PATENT DOCUMENTS

| | | |
|---|---|---|
| JP | A-6-222629 | 8/1994 |
| JP | A-2001-240259 | 9/2001 |
| JP | A-2006-139052 | 6/2006 |
| JP | A-2008-254841 | 10/2008 |

* cited by examiner

*Primary Examiner* — Walter L Lindsay, Jr.
*Assistant Examiner* — Barnabas Fekete
(74) *Attorney, Agent, or Firm* — Oliff & Berridge, PLC

(57) ABSTRACT

When closing a front cover opened in a case where a fixing lever is placed in a fixing position, a guide plate portion formed on the front cover raises the fixing lever together with a support shaft. When a connection pin of the fixing lever enters a cam groove provided in the front cover, the fixing lever obtains a closed state in which the fixing lever is connected to the cam groove.

14 Claims, 9 Drawing Sheets

OPENING/CLOSING MECHANISM AND IMAGE FORMING APPARATUS

CROSS-REFERENCE TO RELATED APPLICATION

This application is based on and claims priority under 35 USC 119 from Japanese Patent Application No. 2009-199698 filed on Aug. 31, 2009.

BACKGROUND

1. Technical Field

The present invention relates to a cover opening/closing mechanism provided in, e.g., an image forming apparatus (a copying machine, a printer, a facsimile machine, a multifunction apparatus thereof, or the like). More particularly, the invention relates to an image forming apparatus having the opening/closing mechanism.

2. Related Art

The above image forming apparatus is such that various types of opening/closing members are provided openably and closably with respect to an apparatus body thereof. The various types of opening/closing members include a paper feed cassette to be inserted into the apparatus body, a maintenance cover, and a door to be opened when replacement materials such as toner are replaced.

SUMMARY

[1] According to an aspect of the invention, an opening/closing mechanism includes an apparatus body, an opening/closing member, at least one fixing lever, a retaining unit, a coupled portion, an elastic member and a connecting unit. The opening/closing member is openably/closably provided in the apparatus body. The fixing lever is rotatably supported by one of the apparatus body and the opening/closing member via a support shaft, and is configured to fix a state in which the opening/closing member is closed. The retaining unit is configured to retain the support shaft movably. The coupled portion is provided at the apparatus body or the opening/closing member, at a side opposite to a side at which the fixing lever is supported, to be connected to the fixing lever when the opening/closing member is closed. The elastic member is configured to set a rotation angle position of the fixing lever at one of (i) a fixing position at which the opening/closing member is fixed by connecting the fixing lever to the coupled portion, and (ii) a standby position at which the fixing lever is connectable to the coupled portion. The connecting unit is configured to move the fixing lever together with the support shaft to a connectable position, in which the fixing lever is connectable to the coupled portion, by acting upon the fixing lever when the opening/closing member is closed in a state in which the opening/closing member is spaced from the apparatus body and in which the fixing lever is in the fixing position. The support shaft urging unit is configured to urge the support shaft to a position corresponding to the standby position of the fixing lever.

BRIEF DESCRIPTION OF THE DRAWINGS

Exemplary embodiments of the invention will be described in detail based on the following figures, wherein:

FIGS. 5A to 8C are side views illustrating an operation in a case where the fixing lever is "reversed" according to the additional embodiment.

DETAILED DESCRIPTION

Hereinafter, an embodiment of the invention is described with reference to the accompanying drawings.

Figure 1:
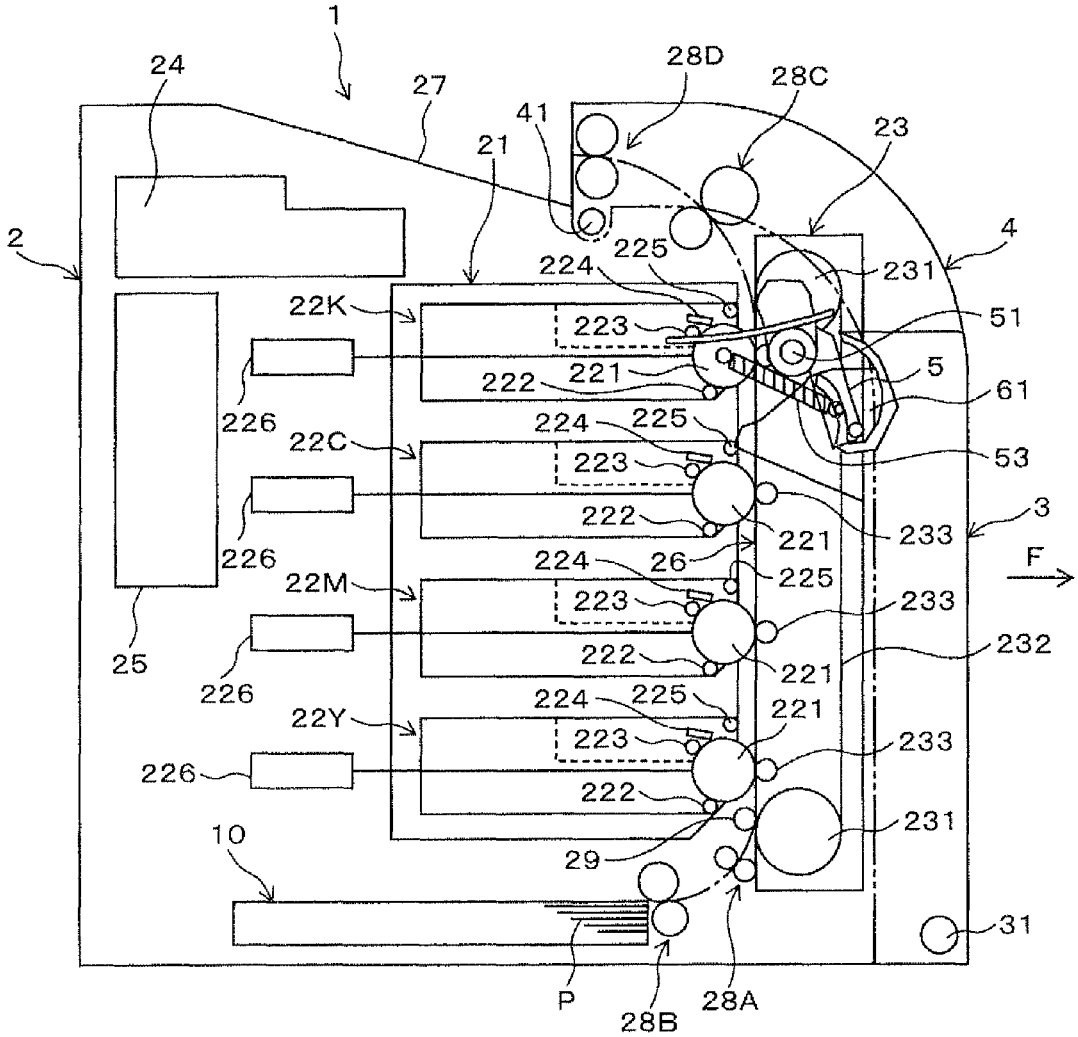
FIG. 1 is a side view schematically illustrating an inner structure of a printer according to an embodiment of the invention.

FIG. 1 schematically illustrates an internal configuration of a printer 1 serving as an image forming apparatus according to an embodiment of the invention. As illustrated in FIG. 1, the printer 1 includes an apparatus body 2, a front cover 3 for releasing a front side of the apparatus body 2 (a direction F illustrated in FIG. 1 is the forward direction of the printer 1), and an upper cover 4 for releasing a front upper side of the apparatus body 2. Meanwhile, in the following description, unless particularly described otherwise, front, rear, left, and right directions refer to directions in a state in which the apparatus body 2 is seen from the front side thereof.

The apparatus body 2 incorporates a full color image forming portion 21, a transfer portion 23 placed opposite to the front of the image forming portion 21, a power supply unit 24, and a control portion 25. A paper feed cassette 10 that stacks and houses a large number of sheets of paper P is inserted into a lower part of the apparatus body 2. The paper feed cassette 10 is drawn back from the apparatus body 2. Then, sheets of paper P are housed in the paper feed cassette 10.

The front cover 3 is such that the bottom part thereof is rotatably supported by the apparatus body 2 via a hinge shaft 31 extending laterally. The front cover 3 is frontwardly turned from the apparatus body 2 so as to be released therefrom. When turned rearwardly, the front cover 3 is closed in a state in which the front cover 3 is erected upright with respect to the apparatus body 2.

The upper cover 4 is such that a rear end portion thereof is rotatably supported by the apparatus body 2 via a hinge shaft 41 extending laterally. When turned upwardly, the upper cover 4 is released from the apparatus body 2. When turned downwardly, the upper cover 4 is brought into a closed state. The upper cover 4 is closed to overlap with the top portion of the front cover 3, which is in a closed state, from front. Accordingly, when the upper cover 4 is not opened, the front cover 3 cannot be opened. The upper cover 4 is used so as to be closed after the front cover 3 is closed.

The image forming portion 21 is configured mainly by four color image forming units 22Y, 22M, 22C, and 22K respectively constituted by process cartridges that are provided in a state in which the process cartridges are stacked from bottom up above the paper feed cassette 10. The image forming units 22Y, 22M, 22C, and 22K are respectively used to form yellow, magenta, cyan, and black toner images. Each of the image forming units 22Y, 22M, 22C, and 22K includes a photoreceptor drum 221, a charging roller 222, a development roller 223, a photoreceptor drum cleaner 224, a neutralization roller 225, and the like. A latent image is formed on the photoreceptor drum 221 by an exposure device 226 provided in rear of each of the image forming units 22Y, 22M, 22C, and 22K.

The transfer portion 23 includes a conveyance belt 232 looped around a pair of upper and lower belt rollers 231, and transfer rollers 233 provided on the inner side of the conveyance belt 232 at positions corresponding to the photoreceptor drums 221 of the image forming units 22Y, 22M, 22C, and 22K, respectively.

A sheet of paper P to be printed rises on a conveyance path 26 formed between the image forming portion 21 and the transfer portion 23 from the paper feed cassette 10 and is discharged to a discharge tray 27 formed on an upper part of the apparatus body 2. The paper conveyance path 26 includes the gap between the conveyance belt 232 and each photoreceptor drum 221, a paper feed roller pair 28A and a pickup roller pair 28B which are placed at the upstream side of the conveyance belt 232, and a fixing roller pair 28C and a paper discharge roller pair 28D which are placed at the downstream side of the conveyance belt 232.

Color image information is input to the printer 1 from a personal computer or the like. When color image information is input thereto, a sheet of paper P is fed by the pickup roller pair 28B from the paper feed cassette 10 to the paper feed roller pair 28A. Then, the sheet of paper P is upwardly conveyed by being electrostatistically adsorbed onto the conveyance belt 232 electrostatically charged by a charging device 29. On the other hand, the photoreceptor drum 221 of each of the image forming units 22Y, 22M, 22C, and 22K is electrostatically charged by a charging roller 222. Thus, an electrostatic latent image corresponding to each of color images respectively associated with the image forming units 22Y, 22M, 22C, and 22K is formed on a surface of the photoreceptor drum 221 of the associated image forming unit by an exposure device 226. Each color latent image is developed on the surface of the associated photoreceptor drum 221 by an associated development roller 223. The developed latent images are transferred onto the sheet of paper P conveyed by the conveyance belt 232 to ascend. Consequently, an image is developed.

Such development of the latent images transferred from the photoreceptor drums 221 onto the sheet of paper P is performed in the image forming units 22Y, 22M, 22C, and 22K, sequentially, at predetermined timings. When the sheet of paper P passes through the most downstream-side image forming unit 22K corresponding to black, a full color toner image is formed on the sheet of paper P.

The sheet of paper P, onto which the full color toner image is transferred while passing through the black image forming unit 22, passes through the gap between the fixing roller pair 28C. The full color toner image is fixed onto the sheet of paper P by the fixing roller pair 28C through the action of clamping and heating. After passing through the gap between the fixing roller pair 28C, the sheet of paper P is discharged to the discharge tray 27 by the discharge roller pair 28D.

Figure 2:
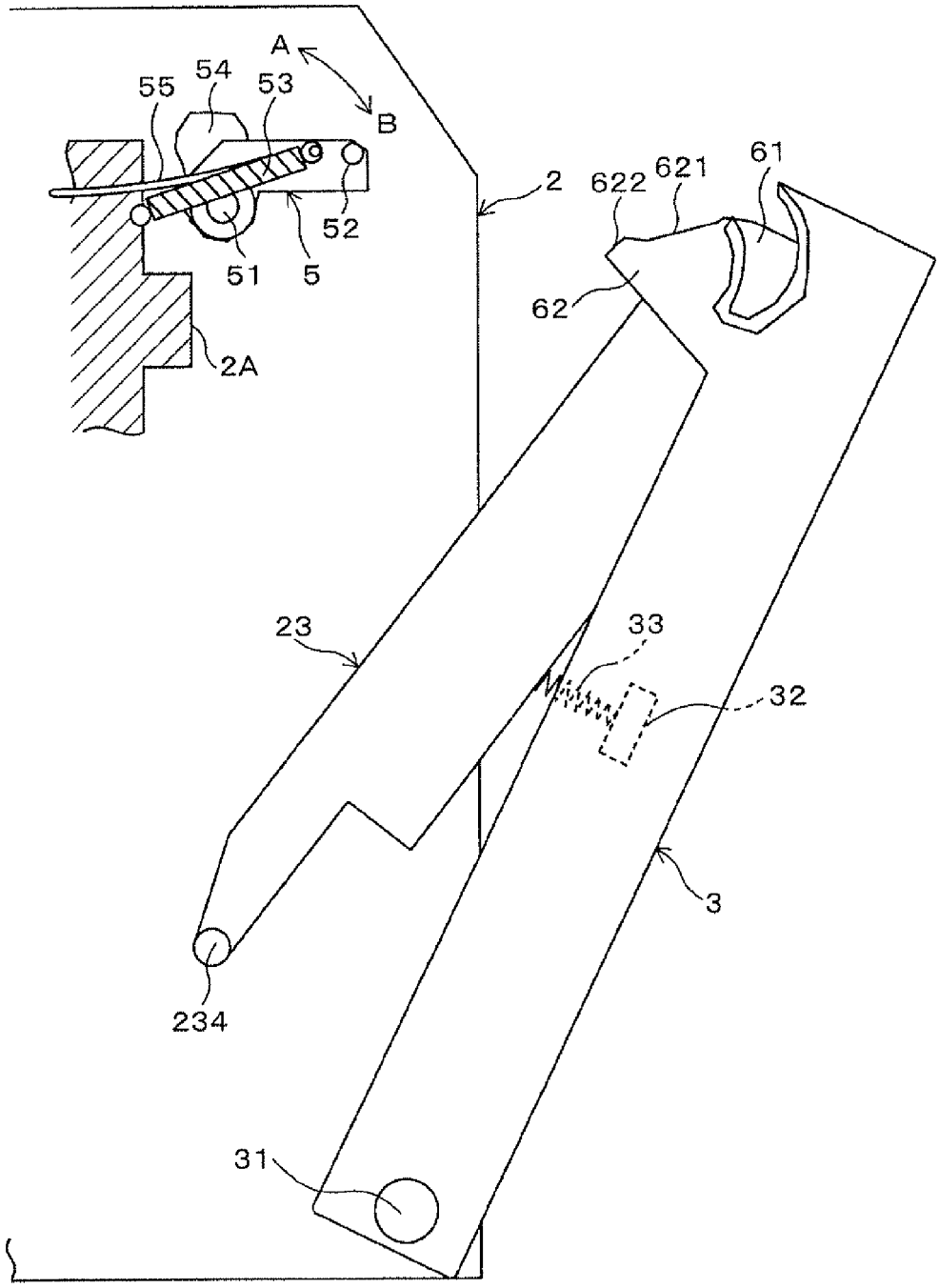
FIG. 2 is a side view illustrating a mounting structure for mounting a front cover according to the embodiment on an apparatus body.

FIG. 2 is a state in which the front cover 3 is opened to the front side. The above transfer portion 23 is supported so that the bottom portion thereof can tilt anteroposteriorly with respect to the apparatus body 2 via a shaft 234. When the front cover 3 is opened, the transfer portion 23 is opened to the front side in a state in which the top portion thereof makes contact with the inner side of the front cover 3. In this condition, the image forming units 22Y, 22M, 22C, and 22K are brought into a released state. Accordingly, troubles caused on the conveyance path 26, such as a paper jam, can be dealt with by opening the front cover 3.

A coil spring 33 extending to the side of the apparatus body 2 via a spring support portion 32 is provided on the inner surface (opposed surface to the apparatus body 2) of the front cover 3. As the front cover 3 is closed, the transfer portion 23 is also closed. The top part of the transfer portion 23 makes contact with the front end portion of a body frame 2A, which is a part of the apparatus body 2. Then, the front cover 3 is closed. Thus, the coil spring 33 is put into a compressed state. The transfer portion 23 is pushed by the coil spring 33 against the body frame 2A, so that the transfer portion 23 is positioned and held in an operating position in which the transfer position 23 makes contact with the body frame 2A.

In the foregoing description, the fundamental configuration and operation of the printer 1 have been described. Next, a mechanism for closing the above front cover 3 to the apparatus body 2 is described hereinafter.

As illustrated in FIG. 2, fixing levers 5 are provided at the top portion of the apparatus body 2. The fixing levers 5 are provided thereat as a pair of left and right fixing levers. Each of a pair of left and right fixing levers 5 is fixed to one support shaft 51 extending laterally at one end portion thereof. The fixing levers 5 are integrally connected to each other via the support shaft 51 and supported by the apparatus body 2 rotatably in both directions indicated by arrows A and B. A connection pin 52 whose axial direction extends laterally is formed on one side surface of a leading end part of each of the fixing levers 5.

Figure 3A:
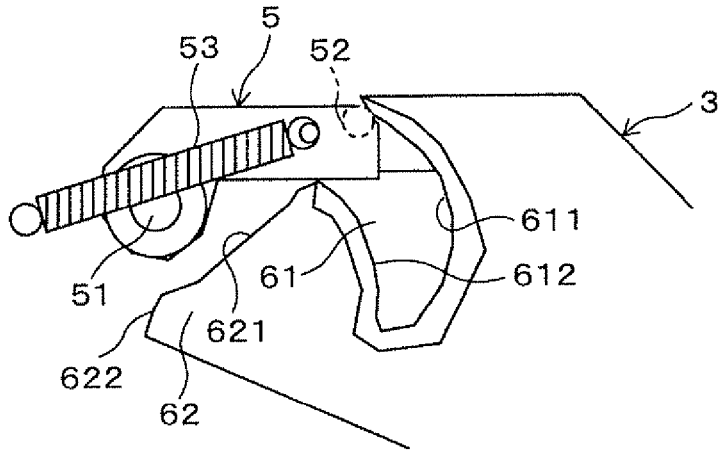
FIGS. 3A to 3C are side views of a closing mechanism for the front cover according to the embodiment, illustrating an operation to be performed when the front cover is closed in a state in which a fixing lever is placed in a standby position.
Figure 3B:
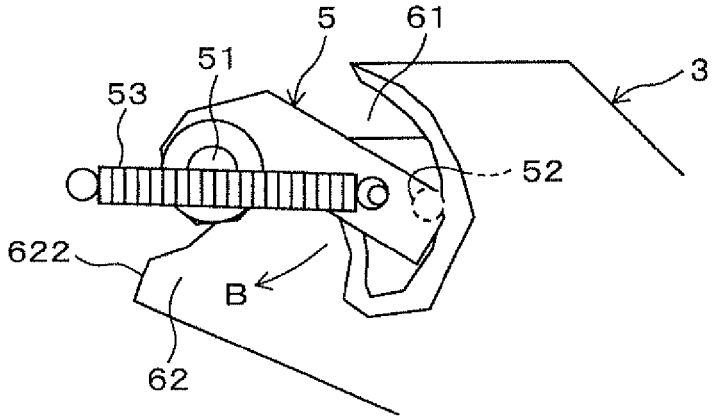
Figure 3C:
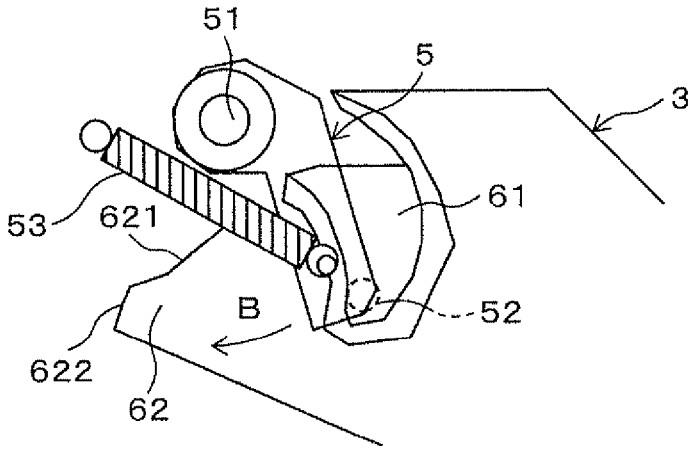

Each of the fixing levers 5 is configured to be positioned by a tension spring 53 in one of two positions that are a standby position illustrated in FIG. 2 and a fixing position illustrated in FIG. 3C. Each of the fixing levers 5 has a shape like a letter "L" so as to be inclined upwardly to the front from an end thereof fixed to the support shaft 51 in the standby position and then extend straightly to the front through a bend portion. Each of the tension springs 53 is latched by the body frame 2A at one end thereof and also latched by the associated fixing lever 5 at the other end thereof. When turned in the direction A, the fixing levers 5 are stopped in the standby position. When turned in the direction B, the fixing levers 5 are stopped in the fixing position. An intermediate position in which the tension of the tension spring 53 is maximized is present between both the standby position and the fixing position.

The support shaft 51 is retained in an elongated hole 54 which is formed in the apparatus body 2 and extends in an up/down direction. Each of the fixing levers 5 can swing together with the support shaft 51 in an up/down direction along the elongated hole 54. The support shaft 51 is always urged by a plate spring 55 to the position of the bottom portion of the elongated hole 54, which is a position corresponding to the standby position of each of the fixing levers 5. The plate spring 55 is latched by the body frame 2A at one end portion thereof and extends therefrom to the front so that the other end portion thereof elastically pushes an upper part of the support shaft 51.

On the other hand, a cam groove 61 which the connection pin 52 of each of the fixing levers 5 enters is formed in the top portion of the front cover 3 and in a position corresponding to an associated one of the left and right fixing levers 5. Each of the cam grooves 61 is formed like a circular arc such that the outer circumference side thereof is placed to the front.

A triangular guide plate portion 62 protruding towards the apparatus body 2 is formed at one side of the cam groove 61 in the inner surface of the front cover 3 and in a position corresponding to each of the above fixing levers 5. An inclined surface 621 formed as an upper edge of each of the guide plate portions 62 acts upon the associated fixing lever 5 so that when each of the fixing levers 5 is placed in the fixing position, the associated fixing lever 5 is moved to a connectable position in which the associated fixing lever 5 is connectable to the associated cam groove 61. Each convex portion 622 is formed at a leading end of the associated inclined surface 621. Each of the inclined surface 621 extends linearly from the associated convex portion 622 to an opening edge of the associated cam groove 61. Each of the cam grooves 61 is laterally deviated from the associated guide plate portion 62. The lateral position of each of the cam grooves 61 corresponds to that of the connection pin 52. The lateral position of each of the guide plate portions 62 corresponds to that of the associated fixing lever 5.

Hereinafter, an operation of closing the front cover 3 is described hereinafter.

In a state in which the front cover 3 is opened, the fixing levers 5 are positioned in the standby position by the tension springs, as illustrated in FIG. 2. As the opened front cover 3 is closed from this state, the connection pin 52 makes contact with the top portion of the front side inner surface 611 of each of the cam grooves 61, as illustrated in FIG. 3A. Each of the cam grooves 61 is configured such that when arranged close to the associated fixing lever 5, the top end of the associated front side inner surface 611 is higher than that of an associated rear side inner surface 612. Thus, each of the connection pins 52 passes through the upper opening of each of the cam grooves 61 and makes contact with the top portion of each of the front side inner surfaces 611.

Next, as the front cover 3 is closed, each of the connection pins 52 enters the associated cam groove 61 while descending along the associated front side inner surface 611. Consequently, the fixing levers 5 are turned in a direction B. Each of the turned fixing levers 5 passes through the intermediate position, as illustrated in FIG. 3B. Then, each of the turned fixing levers 5 is "reversed", i.e., turned to a side opposite to the standby position with respect to the intermediate position by a force of the associated tension spring 53 and reaches the fixing position, as illustrated in FIG. 3C. At that time, each of the connection pins 52 connects with the bottom portion of the associated cam groove 61 and is drawn by the associated fixing lever 5 in a direction in which the front cover 3 is closed. Consequently, the fixing levers 5 are connected to the cam grooves 61, respectively. Thus, the front cover 3 is retained in a state in which the front cover 3 is closed to the apparatus body 2. Incidentally, in FIGS. 3A to 3C, the drawing of each of the elongated holes 54 and the plate springs 55 is omitted.

Figure 4A:
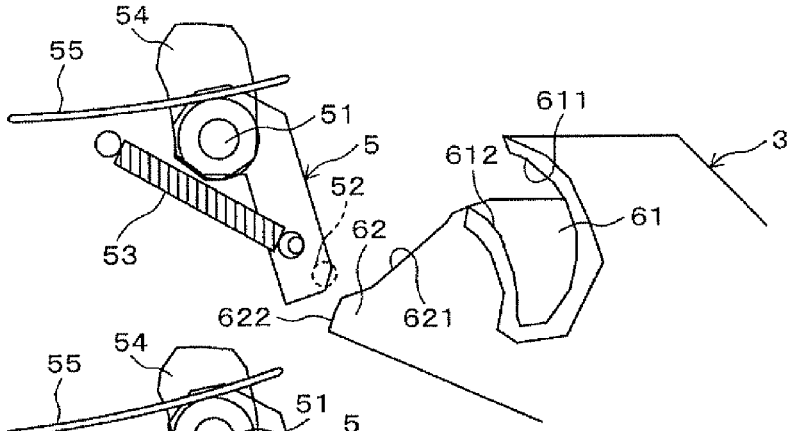
FIGS. 4A to 4D are side views illustrating an operation in a case where the fixing lever is "reversed" in the closing mechanism.

Next, an operation of closing the front cover 3 from a state, in which the fixing levers 5 are "reversed" for some reason from the standby position to the fixing position when the front cover 3 is opened, is described hereinafter. As the front cover 3 is closed, a leading end of the inclined surface 621 of the guide plate portion 62 comes close to that of each of the fixing levers 5 placed in the fixing position, as illustrated in FIG. 4A.

Figure 4B:
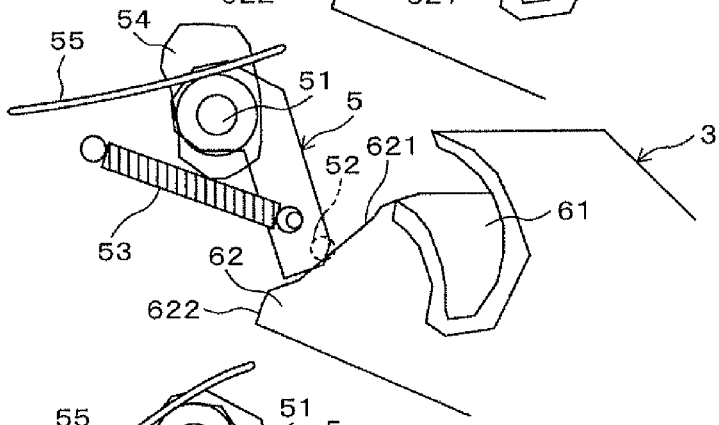
Figure 4C:
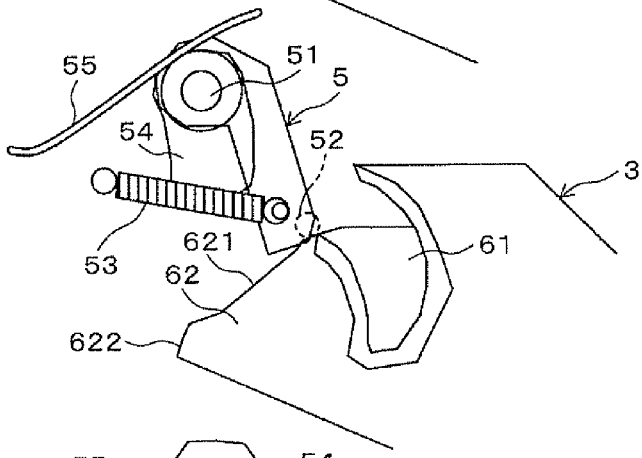
Figure 4D:
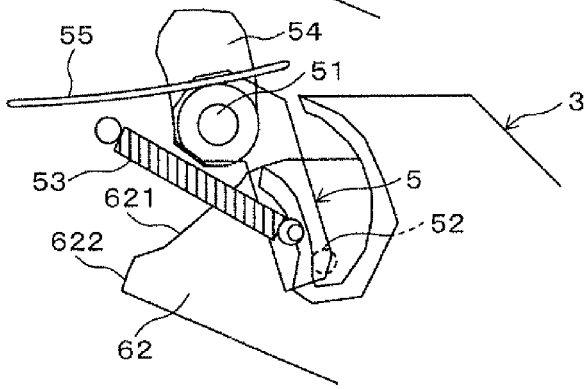

Then, as illustrated in FIGS. 4B and 4C, each of the inclined surfaces 621 makes contact with the associated connection pin 52. In addition, as the front cover 3 is closed, each of the connection pins 52 slides on the associated inclined surface 621 to ascend. The fixing levers 5 follow this operation of the pins 52 and ascend together with the support shaft 51 along the elongated hole 54. Then, each of the connection pins 52 reaches the associated cam groove 61. In addition, each of the connection pins 52 is caused by a force of the associated tension spring 53 to enter the associated cam groove 61. Thus, the fixing levers 5 return to the fixing position. At that time, the front cover 3 is drawn by the fixing levers 5 into a direction in which the front cover 3 is closed. Consequently, the fixing levers 5 are connected with the cam grooves 61, respectively. The front cover 3 is retained in a state in which the front cover 3 is closed to the apparatus body 2.

Figure 5:
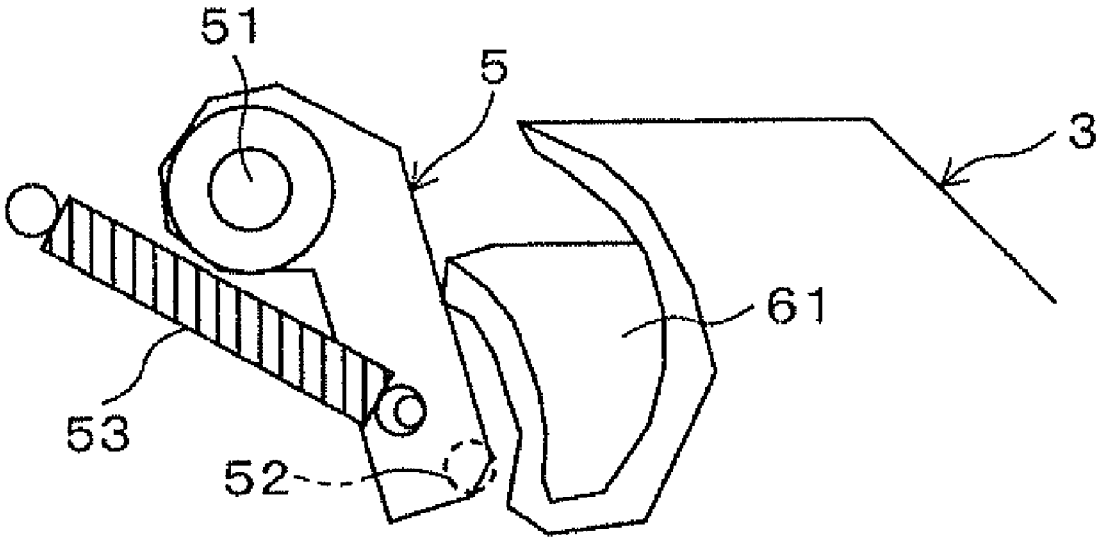
FIG. 5 is a side view illustrating a closing mechanism when the cover is not provided with the closing mechanism.

Assuming that the front cover 3 does not have the guide plate portions 62, the top portion of the front cover 3 interferes with the fixing levers 5 placed in the fixing position, as illustrated in FIG. 5. Thus, it is impossible that the fixing levers 5 are connected to the cam grooves 61, respectively. According to the present embodiment, as an operation of closing the front cover 3 is performed, the guide plate portion 62 causes the fixing levers 5 to rise and move to a connectable position in which the fixing levers 5 can be connected to the cam groove 61. Consequently, the connection pin 52 can be connected to the cam groove 61. The cover 3 can surely be closed.

In addition, the left and right fixing levers 5 are integrally connected to each other by the support shaft 51. Thus, in a case where only one of the fixing levers 5 is placed in the standby position or the connectable position and where the other fixing lever 5 is placed neither in the standby position nor in the connectable position, both the fixing levers 5 are not connected to the cam grooves 61. Accordingly, the invention prevents occurrences of troubles such as a unilateral closure in which only one of the fixing levers 5 is connected to the associated cam groove 61.

Figure 6A:
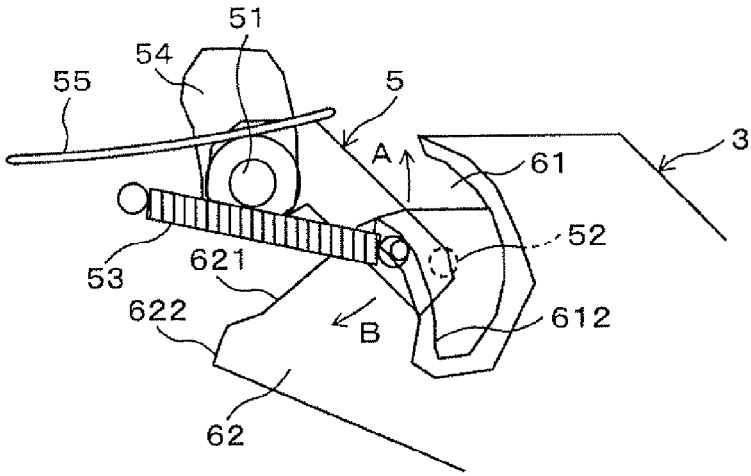
FIGS. 6A to 6C are side views of the closing mechanism, illustrating an operation in a case where the front cover is opened.
Figure 6B:
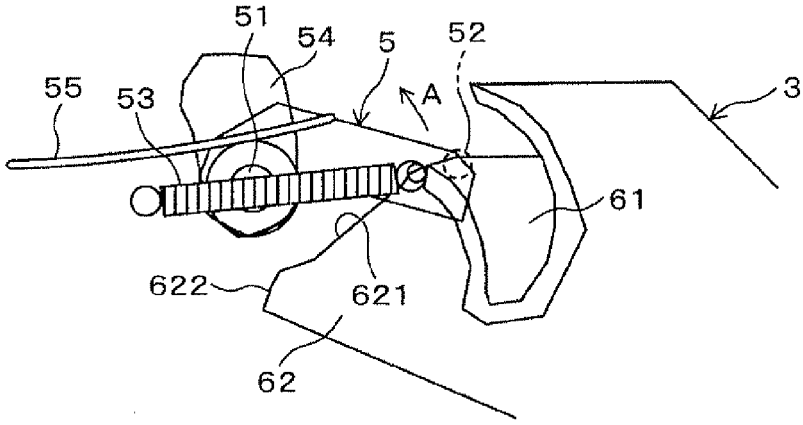
Figure 6C:
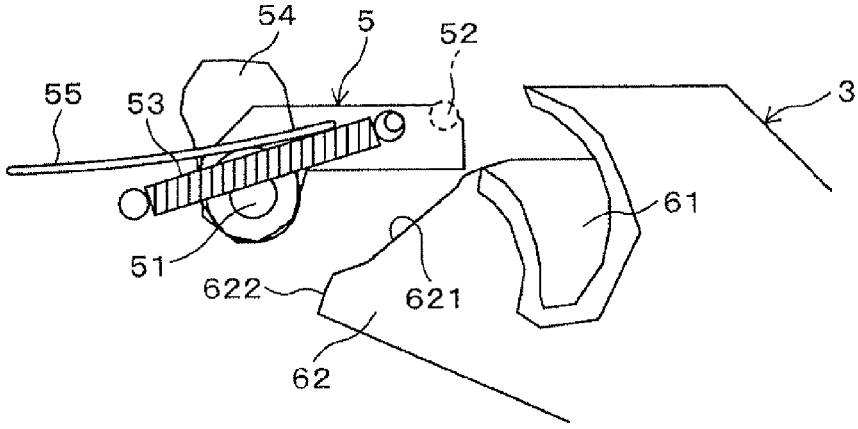

Next, an operation of opening the front cover 3 in the closed state is described hereinafter with reference to FIGS. 6A to 6C. As illustrated in FIG. 6A, as the front cover 3 is opened, the connection pin 52 of each of the fixing levers 5 urged in the direction B by the tension springs 53 ascends while sliding on the rear side inner surface 612 of the associated cam groove 61. Thus, the fixing levers 5 are turned in the direction A. At that time, the support shaft 51 is pressed by the plate spring 55 to prevent the support shaft 51 from rising. Then, as illustrated in FIG. 6B, each of the fixing levers 5 reaches the intermediate position just before the associated connection pin 52 goes out of the associated cam groove 61. In addition, the fixing levers 5 are turned in the direction A to return the initial standby position. Consequently, as illustrated in FIG. 6C, the fixing levers 5 are completely disengaged from the cam grooves 61, respectively. The printer 1 is brought into a state in which the front cover 3 can be opened.

According to the above one embodiment, even when the fixing levers 5 are not in the standby position and in the fixing position, as described above, the front cover 3 can always and surely be closed to the apparatus body 2. In addition, each of the elongated holes 54 is formed so that the support shaft 51 for the fixing levers 5 is movably held. Additionally, the plate springs 55 are used as members for downwardly urging the support shaft 51. These components can simply be constructed. In addition, these components can be compacted. The guide plate portions 62 for moving the fixing levers 5 to the connectable position is simply constructed. Thus, the fixing levers 5 can reliably be moved to the connectable position.

Next, an additional embodiment of a mechanism for closing the above front cover 3 is described with reference to FIGS. 7A to 9C. According to this embodiment, a pair of left and right connection pins 7 whose axial directions extend laterally are provided on both side portions of the apparatus body 2 so that both the side portions correspond to the top portion of the front cover 3. The connection pins 7 are provided to be fixed to, e.g., the body frame 2A. In FIGS. 7A to 9C, the drawing of the front cover 3 is omitted.

Figure 7A:
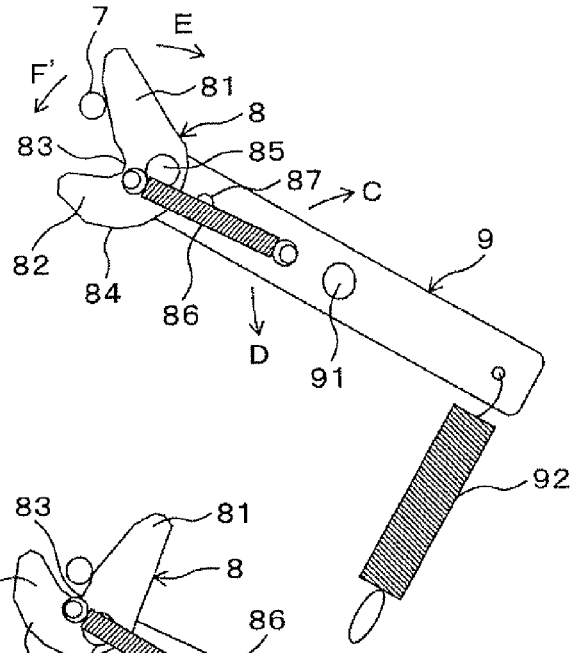
FIGS. 7A to 7C are side views of a closing mechanism for a front cover according to an additional embodiment of the invention, illustrating an operation to be performed when a fixing lever is in a standby position.
Figure 7B:
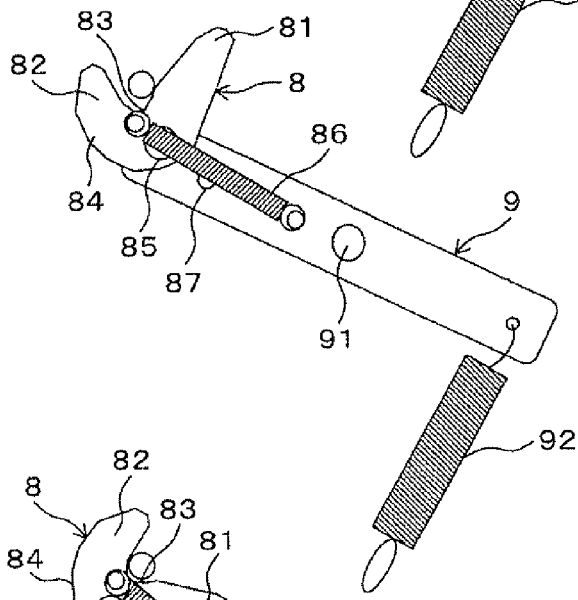
Figure 7C:
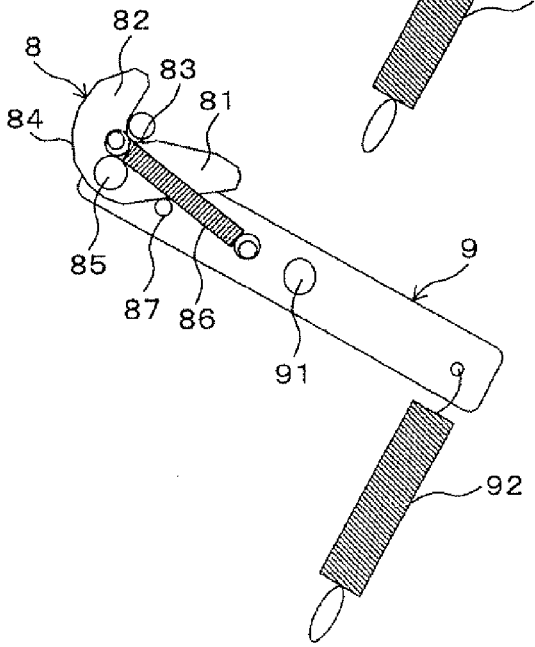

On the other hand, fixing levers 8 connected to the connection pins 7 so as to bring the front cover 3 into a closed state are attached to the front cover 3 via swinging levers 9, respectively. Each of the swinging levers 9 is supported by the front cover 3 swingably in directions respectively designated with arrows C and D via a shaft 91 whose axial direction extends laterally. The shaft 91 is provided to pass through a middle part of each of the swinging levers 9. As illustrated in FIG. 7A, each of the shafts 91 is inclined downwardly to the front by a tension spring 92 hooked from the front cover 3 onto the front side end of the associated swinging lever 9.

Each of the fixing levers 8 has a long piece portion 81 and a short piece portion 82 which are bent like a letter "L". A concave portion 83 is formed on the inner side of a bent part of each of the fixing levers 8. A circular-arc-like surface 84 is formed on the outer edges of the bent part and the short piece portion 82. Each of the left and right fixing levers 8 is configured such that the bent part is fixed to one support shaft 85 extending laterally. Each of the fixing levers 8 which are integrally connected to each other via the support shaft 85 is supported by a rear end portion of the associated swinging lever 9 rotatably in directions respectively designated with arrows E and F'. A tension spring 86 is hooked onto each of the fixing levers 8 from the associated swinging lever 9. The fixing levers 8 are positioned in one of two positions that are a standby position in which the fixing levers 8 are respectively connected to the connection pins 7 illustrated in FIG. 7A, and a fixing position illustrated in FIG. 7C.

Each of the fixing levers 8 placed in the standby position is such that the associated concave portion 83 is directed backwardly, that the associated long piece portion 81 is placed closer to the front than the associated short piece portion 82, and that the leading end of the associated long piece portion 81 is placed at a position higher than the position of the leading end of the associated short piece portion 82. When the fixing levers 8 placed in the standby position are turned in the direction E, the fixing levers 8 are positioned in the fixing position. Each of the fixing levers 8 placed in the fixing position is such that the associated concave portion 83 is directed frontwardly, that the associated short piece portion 82 is placed to the front, and that the long piece portion 81 extends frontwardly from the bent part. Each of the fixing levers 8 is stopped in the fixing position by causing an outer edge of the long piece portion 81 to abut against a stopper 87 provided on the swinging lever 9. An intermediate position at which the tension of the tension spring 86 is maximized is present on each of the fixing levers 8 turned between both the standby position and the fixing position.

Hereinafter, an operation of closing the front cover 3 is described.

In a state in which the front cover 3 is opened, each of the fixing levers 8 is positioned in the standby position by the associated tension spring 86, as illustrated in FIG. 7A. As the opened front cover 3 is closed, first, each of the connection pins 7 provided at the side of the apparatus body 2 makes contact with the inner surface of the long piece portion 81 of the associated fixing lever 8, as illustrated in FIG. 7A. Subsequently, each of the fixing levers 8 relatively pushed by the connection pins 7 is turned in the direction E. Then, each of the fixing levers 8 passes through the intermediate position illustrated in FIG. 7B, and is "reversed" and stopped in the fixing position illustrated in FIG. 7C. In this state, each of the connection pins 7 is fit into the associated concave portion 83 and connected to the associated fixing lever 8. The front cover 3 is retained in a state in which the front cover 3 is closed to the apparatus body 2.

Figure 8A:
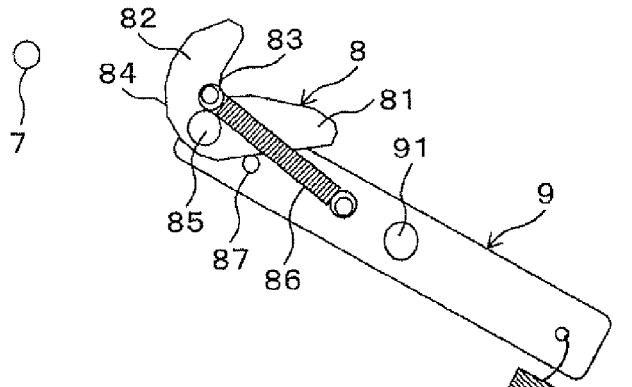
Figure 8B:
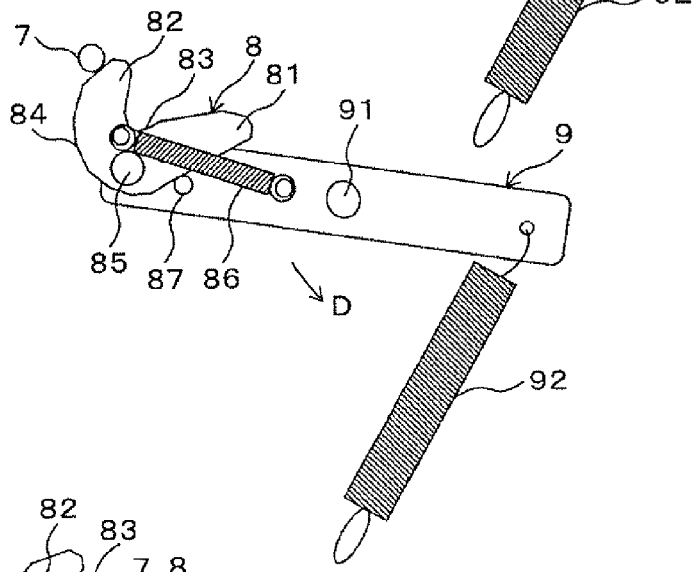

Next, an operation of closing the front cover 3 in a state, in which each of the fixing levers 8 is "reversed" from the standby position to the fixing position for some reason when the front cover 3 is opened, is described hereinafter. As the released front cover 3 is closed, each of the connection pins 7 makes contact with the circular-arc-like surface 84 of the associated short piece portion 82 of the fixing lever 8 placed in the fixing position, as illustrated in FIGS. 8A and 8B.

Figure 8C:
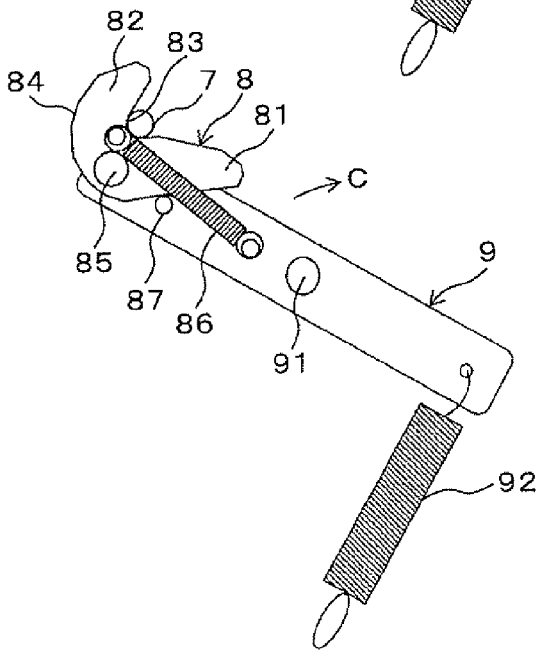

Then, when the front cover 3 is closed, each of the fixing levers 8 is downwardly pushed by the associated connection pin 7. Consequently, each of the swinging levers 9 is turned in the direction D against the force of the associated tension spring 92 while the fixing levers 8 remain placed in the fixing position. Each of the connection pins 7 falls to a position in which each of the connection pins 7 is connectable to the associated fixing lever 8. Subsequently, each of the connection pins 7 climbs over the leading end of the short piece portion 82 of the associated fixing lever 8. Then, each of the swinging levers 9 is freed from pressure due to the associated connection pin 7 so as to be turned in the direction C. Thus, as illustrated in FIG. 8C, each of the connection pins 7 is fit into the associated concave portion 83 so as to be connected to the associated fixing lever 8. Thus, even when the front cover 3 is closed in a state in which each of the fixing levers 8 is in the fixing position, the connection pins 7 are connected to the fixing levers 8, respectively. The front cover 3 is retained in a state in which the front cover 3 is closed to the apparatus body 2.

If the swinging levers 9 do not swing, the short piece portions 82 of the fixing levers 8 placed in the fixing position interfere with the connection pins 7. Thus, it is impossible that the connection pins 7 are connected to the fixing levers 8. According to the present embodiment of the invention, as an operation of closing the front cover 3 is performed, the swinging levers 9 fall, so that each of the fixing levers 8 is moved to a position in which each of the fixing levers 8 is connectable to an associated one of the connection pins 7. Consequently, each of the connection pins 7 can be connected to an associated one of the fixing levers 8. Accordingly, the front cover 3 is surely closed.

Figure 9A:
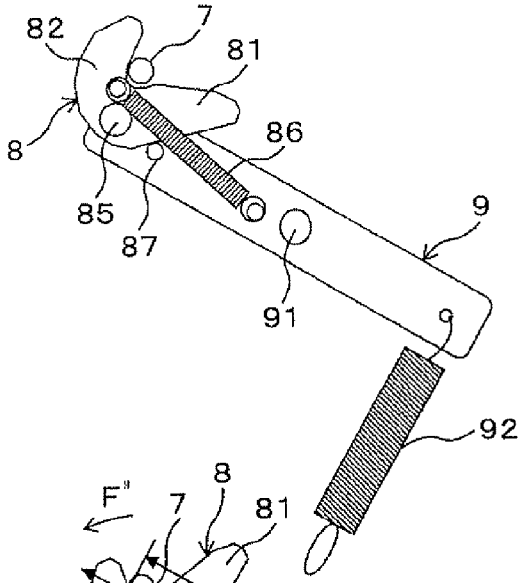
FIGS. 9A to 9C are side views illustrating an operation in a case where a front cover is opened according to the additional embodiment.
Figure 9B:
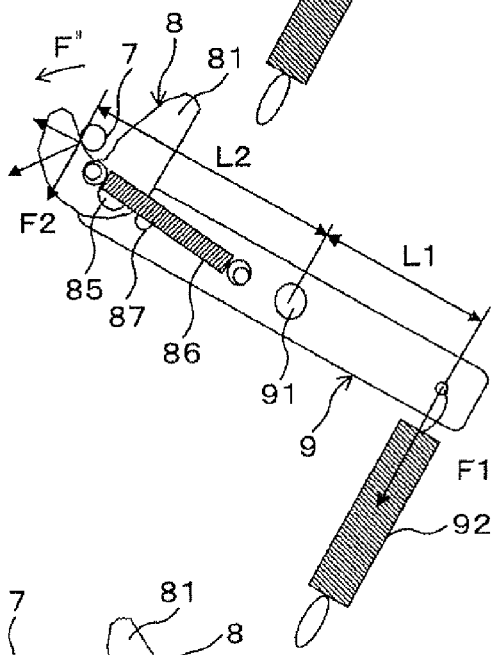
Figure 9C:
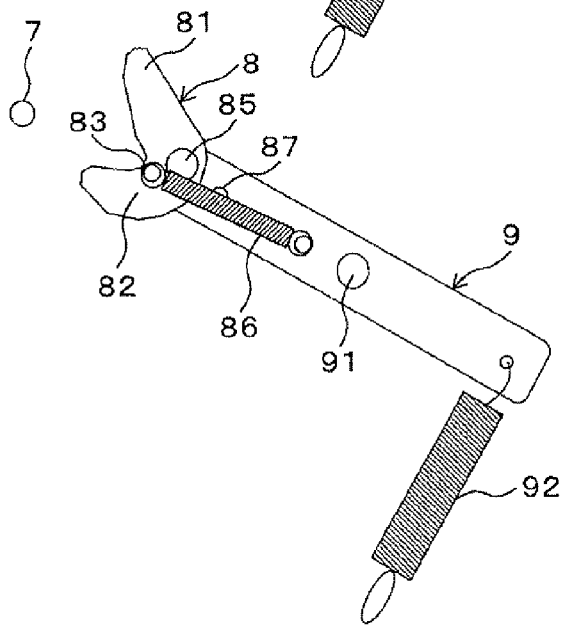

Next, an operation to be performed when the closed front cover 3 is opened is described hereinafter with reference to FIGS. 9A to 9C. As the front cover 3 is opened in a state in which the connection pins 7 are respectively connected to the fixing levers 8, as illustrated in FIG. 9A, the short piece portions 82 of the fixing levers 8 are pushed by the connection pins 7 relatively backwardly, so that each of the fixing levers 8 is turned in the direction F" and reaches an intermediate position, as illustrated in FIG. 9B. Then, each of the fixing levers 8 is additionally turned in the direction F" to return the initial standby position. Consequently, as illustrated in FIG. 9C, each of the connection pins 7 is completely disengaged from the associated fixing lever 8, so that the printer 1 is put into a state in which the front cover 3 can be opened. In order to enable such an operation, as illustrated in FIG. 9B, the relationship among the forces F1 and F2 of the tension springs 92 and 86 and the distances L1 and L2 of the tension springs 92 and 86 from the shaft 91 is set so that $(L1 \times F1) > (F2 \times L2)$.

According to the additional embodiment, each of the fixing levers 8 is supported by an associated one of the swinging levers 9. Thus, an operation of turning each of the fixing levers 8 between the standby position and the fixing position can stably be performed. In addition, appropriate springs are selected as the tension springs 92. Accordingly, an urging force for urging the support shaft 85 to the standby position is easily adjusted.

The invention is not limited to the above embodiments. A door member for replacing a process cartridge and the above paper feed cassette 10, and the like can be used as the opening/closing members. The invention can be applied to such a door member, the paper feed cassette 10, and the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An opening/closing mechanism comprising:

an apparatus body;

an opening/closing member that is openably/closably provided in the apparatus body;

at least one fixing lever that is rotatably supported by one of the apparatus body and the opening/closing member via a support shaft, and that is configured to fix a state in which the opening/closing member is closed;

a retaining unit that is configured to retain the support shaft so that the support shaft can move in a direction perpendicular to an axial direction of the support shaft;

a coupled portion that is provided at the apparatus body or the opening/closing member, at a side opposite to a side at which the fixing lever is supported, to be connected to the fixing lever when the opening/closing member is closed;

an elastic member that is configured to set a rotation angle position of the fixing lever at (i) a fixing position at which the opening/closing member is fixed by connecting the fixing lever to the coupled portion, and (ii) a standby position at which the fixing lever is connectable to the coupled portion;

a connecting unit that is configured to move the fixing lever together with the support shaft to a connectable position in which the fixing lever is connectable to the coupled portion, by (i) moving the support shaft in the direction perpendicular to the axial direction of the support shaft within the retaining unit, and (ii) acting upon the fixing lever when the opening/closing member is closing in a state in which the opening/closing member is spaced from the apparatus body and in which the fixing lever is in the fixing position; and a support shaft urging unit that is configured to urge the support shaft to a position corresponding to the standby position of the fixing lever.

2. The opening/closing mechanism according to claim 1, wherein the retaining unit includes an empty space into which the support shaft is inserted, and retains the support shaft slidably, and the support shaft urging unit includes an elastic member acting upon the support shaft.

3. The opening/closing mechanism according to claim 1, wherein the retaining unit includes a lever member which retains the support shaft swingably, and the support shaft urging unit includes an elastic member which causes the lever member to swing.

4. The opening/closing mechanism according to claim 1, further comprising:

a pair of the fixing levers that is spaced from each other in a direction of an axial line of the support shaft, and that is connected to each other by the connection member integrally rotatably.

5. The opening/closing mechanism according to claim 1, wherein the connecting unit includes a guide portion which is provided in at least one of the opening/closing member and the fixing lever and which is configured to move, when the opening/closing member is closed, the fixing lever to the connectable position in which the fixing lever is connectable to the coupled portion.

6. An image forming apparatus comprising:

the opening/closing mechanism according to claim 1, wherein the apparatus body incorporates an image forming portion having a process cartridge, and the opening/closing member includes a door member for replacing the process cartridge.

7. An image forming apparatus comprising:

the opening/closing mechanism according to claim 1, wherein the apparatus body incorporates an image forming portion, and the opening/closing member includes a paper feed cassette configured to supply paper to the image forming portion.

8. An opening/closing mechanism comprising:

an apparatus body;

an opening/closing member that is openably/closably provided in the apparatus body;

at least one fixing lever that is rotatably supported by one of the apparatus body and the opening/closing member via a support shaft, and that is configured to fix a state in which the opening/closing member is closed;

a retaining unit that is configured to retain the support shaft movably;

a coupled portion that is provided at the apparatus body or the opening/closing member, at a side opposite to a side at which the fixing lever is supported, to be connected to the fixing lever when the opening/closing member is closed;

an elastic member that is configured to set a rotation angle position of the fixing lever at (i) a fixing position at which the opening/closing member is fixed by connecting the fixing lever to the coupled portion, and (ii) a standby position at which the fixing lever is connectable to the coupled portion, the rotation angle of the fixing lever at the fixing position being different from the rotation angle of the fixing lever at the standby position;

a connecting unit that is configured to move the fixing lever together with the support shaft to a connectable position in which the fixing lever is connectable to the coupled portion, by (i) moving the support shaft in the direction perpendicular to the axial direction of the support shaft, and (ii) acting upon the fixing lever when the opening/closing member is closing in a state in which the opening/closing member is spaced from the apparatus body and in which the fixing lever is in the fixing position; and a support shaft urging unit that is configured to urge the support shaft to a position corresponding to the standby position of the fixing lever.

9. The opening/closing mechanism according to claim 8, wherein the retaining unit includes an empty space into which the support shaft is inserted, and retains the support shaft slidably, and the support shaft urging unit includes an elastic member acting upon the support shaft.

10. The opening/closing mechanism according to claim 8, wherein the retaining unit includes a lever member which retains the support shaft swingably, and the support shaft urging unit includes an elastic member which causes the lever member to swing.

11. The opening/closing mechanism according to claim 8, further comprising:

a pair of the fixing levers that is spaced from each other in a direction of an axial line of the support shaft, and that is connected to each other by the connection member integrally rotatably.

12. The opening/closing mechanism according to claim 8, wherein the connecting unit includes a guide portion which is provided in at least one of the opening/closing member and the fixing lever and which is configured to move, when the opening/closing member is closed, the fixing lever to the connectable position in which the fixing lever is connectable to the coupled portion.

13. An image forming apparatus comprising:

the opening/closing mechanism according to claim 8, wherein the apparatus body incorporates an image forming portion having a process cartridge, and the opening/closing member includes a door member for replacing the process cartridge.

14. An image forming apparatus comprising:

the opening/closing mechanism according to claim 8, wherein the apparatus body incorporates an image forming portion, and the opening/closing member includes a paper feed cassette configured to supply paper to the image forming portion.

* * * * *